US007335087B2

(12) United States Patent
Tanaka et al.

(10) Patent No.: US 7,335,087 B2
(45) Date of Patent: Feb. 26, 2008

(54) EYEGLASS LENS PROCESSING APPARATUS

(75) Inventors: Motoshi Tanaka, Gamagori (JP); Yoichi Sugiura, Hekinan (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 11/606,053

(22) Filed: Nov. 30, 2006

(65) Prior Publication Data

US 2007/0135019 A1 Jun. 14, 2007

(30) Foreign Application Priority Data

Nov. 30, 2005 (JP) ..... P2005-347136

(51) Int. Cl.
*B24B 49/00* (2006.01)

(52) U.S. Cl. ..... 451/5; 451/10; 451/11; 451/255; 451/256

(58) Field of Classification Search ..... 451/5, 451/8, 9, 10, 11, 42, 43, 255, 256
See application file for complete search history.

(56) References Cited

U.S. PATENT DOCUMENTS

| | | | | |
|---|---|---|---|---|
| 5,333,412 | A | 8/1994 | Matsuyama | |
| RE35,898 | E | 9/1998 | Shibata et al. | |
| 6,283,826 | B1 | 9/2001 | Mizuno | |
| 6,859,336 | B1 * | 2/2005 | Wada et al. | 359/819 |
| 7,169,013 | B2 * | 1/2007 | Mizuno et al. | 451/5 |
| 2004/0097168 | A1 * | 5/2004 | Igarashi et al. | 451/5 |
| 2004/0192170 | A1 | 9/2004 | Mizun | |

FOREIGN PATENT DOCUMENTS

| | | | |
|---|---|---|---|
| EP | 1-366-856 | A2 | 12/2003 |
| EP | 1-716-971 | A1 | 11/2006 |
| EP | 1 716 971 | A1 | 11/2006 |
| WO | WO 2004/103637 | A1 | 12/2004 |

* cited by examiner

*Primary Examiner*—Eileen P. Morgan
(74) *Attorney, Agent, or Firm*—Sughrue Mion, PLLC

(57) ABSTRACT

An eyeglass lens processing apparatus includes: a controller that controls a second driver for rotating lens chucks for chucking an eyeglass lens and a third driver for changing an axis-to-axis distance between an axis of a processing tool and an axis of the lens chucks so that a processing load falls below an allowable value; and a processing mode selector that selects one of a first processing mode in which the allowable value is set to be high, and a second processing mode in which the allowable value is set to be low so as to suppress axis deviation when the lens having a surface slipping readily is processed. The controller controls the first driver so that a second chucking pressure of the lens chucks when the second processing mode is selected is smaller than a first chucking pressure of the lens chucks when the first processing mode is selected.

8 Claims, 10 Drawing Sheets

EYEGLASS LENS PROCESSING APPARATUS

BACKGROUND OF THE INVENTION

The present invention relates to an eyeglass lens processing apparatus which processes an eyeglass lens.

In an eyeglass lens processing apparatus, an eyeglass lens is rotated while being held (chucked) by two lens chucks, and the periphery of the lens is processed by a processing tool such as a grindstone so as to substantially conform to a desired target lens shape. The chucking of the lens is performed by fixedly attaching a cup serving as a fixture to the rear refractive surface of the lens by suction, adhesion, or the like, mounting the cup to which the lens is fixed to a cup receiver at a distal end of the one lens chuck, and allowing a lens presser at a distal end of the other lens chuck to abut on the lens.

When the periphery of the lens is processed with the processing tool which rotates at high speed, if a load exceeding the holding (chucking) force of the lens is applied to the lens, axis deviation in a rotation direction may occur between the cup and the lens. In particular, in a liquid-repellent lens whose front refractive surface and rear refractive surface (hereinafter, simply refer to surface) are coated with a liquid-repellant substance to which water, oil, or the like does not stick easily, the possibility of occurrence of axis deviation in the rotation direction is high because the surface slips readily.

It has been assumed that large (high) chucking pressure of the lens chucks suppresses the occurrence of axis deviation in the rotation direction when the lens having the surface slipping readily is processed. However, when the chucking pressure is large (high), axis deviation occurs between the cup and the lens in a lateral (transverse) direction perpendicular to the central axis of rotation of the lens chucks due to the curve of the surface of the lens. For example, as shown in FIG. 8, when the central axis Lx of rotation of two lens chucks 702L and 702R is not aligned with the optical center Lo of the lens and the lens is chucked by the lens chucks 702L and 702R, if the chucking pressure is high, the lateral axis deviation occurs in a direction in which the edge at the chucked portion is thicker.

SUMMARY OF THE INVENTION

Accordingly, it is an object of the present invention to provide an eyeglass lens processing apparatus that suppresses axis deviation of a lens during the process and processes the lens with high accuracy.

In order to solve the object, the present invention is characterized by having the following arrangements.

(1) An eyeglass lens processing apparatus comprising:

a lens chucking unit including two lens chucks for chucking an eyeglass lens and a first driver for moving at least one of the lens chucks in an axial direction of the lens chucks;

a lens rotating unit including a second driver for rotating the lens chucks;

an axis-to-axis distance changing unit including a third driver for changing an axis-to-axis distance between an axis of rotation center of a processing tool for processing a periphery of the lens and an axis of rotation center of the lens chucks;

a controller that controls at least one of the second driver and the third driver so that a processing load applied to the lens during processing falls below a predetermined allowable value; and a processing mode selector that selects one of a first processing mode in which the allowable value of the processing load is set to be high, and a second processing mode in which the allowable value of the processing load is set to be lower than the allowable value of the first processing mode so as to suppress axis deviation when the lens having a surface slipping readily is processed, wherein the controller controls the first driver so that a second chucking pressure of the lens chucks when the second processing mode is selected is smaller than a first chucking pressure of the lens chucks when the first processing mode is selected.

(2) The apparatus according to (1), further comprising a chucking mode selector that selects a mode for chucking the lens by the lens chucks from an optical center chucking mode and a frame center chucking mode, wherein, when the second processing mode and the frame center chucking mode are selected, the controller controls the first driver so that the chucking pressure becomes the second chucking pressure.

(3) The apparatus according to (2), wherein, when the second processing mode and the optical center chucking mode are selected, the controller controls the first driver so that the chucking pressure becomes a third chucking pressure larger than the second chucking pressure.

(4) The apparatus according to (1), further comprising a chucking mode selector that selects a mode for chucking the lens by the lens chucks from an optical center chucking mode and a frame center chucking mode, wherein, when the frame center chucking mode is selected, the controller sets the allowance value of the processing load to be lower than the allowance value of the processing load when the optical center chucking mode is selected.

(5) An eyeglass lens processing apparatus comprising:

two lens chucks that chuck an eyeglass lens;

a first motor that moves at least one of the lens chucks in an axial direction of the lens chucks;

a second motor that rotates the lens chucks;

a third motor that changes an axis-to-axis distance between an axis of rotation center of a processing tool for processing a periphery of the lens and an axis of rotation center of the lens chucks;

a controller that controls the driving of at least one of the second motor and the third motor so that a processing load applied to the lens during processing falls below a predetermined allowable value; and a processing mode selector that selects one of a first processing mode in which the allowable value of the processing load is set to be high, and a second processing mode in which the allowable value of the processing load is set to be lower than the allowable value of the first processing mode so as to suppress axis deviation when the lens having a surface slipping readily is processed, wherein the controller controls the first motor so that a second chucking pressure of the lens chucks when the second processing mode is selected is smaller than a first chucking pressure of the lens chucks when the first processing mode is selected.

(6) The apparatus according to (5), further comprising a chucking mode selector that selects a mode for chucking the lens by the lens chucks from an optical center chucking mode and a frame center chucking mode, wherein, when the second processing mode and the frame center chucking mode are selected, the controller controls the first motor so that the chucking pressure becomes the second chucking pressure.

(7) The apparatus according to (6), wherein, when the second processing mode and the optical center chucking mode are selected, the controller controls the first motor so that the chucking pressure becomes a third chucking pressure larger than the second chucking pressure.

(8) The apparatus according to (5), further comprising a chucking mode selector that selects a mode for chucking the lens by the lens chucks from an optical center chucking mode and a frame center chucking mode, wherein, when the frame center chucking mode is selected, the controller sets the allowance value of the processing load to be lower than the allowance value of the processing load when the optical center chucking mode is selected.

DESCRIPTION OF THE PREFERRED EMBODIMENTS

Figure 1:
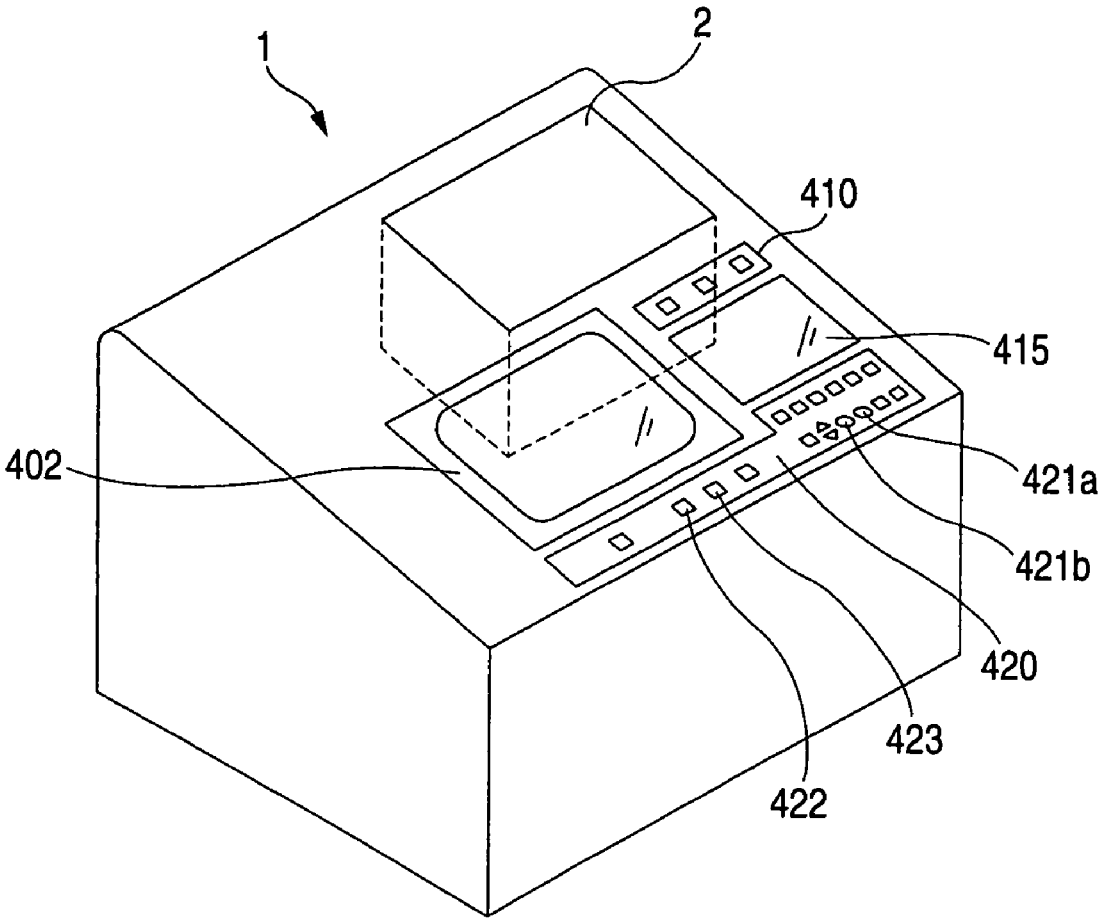
FIG. 1 is a view showing a schematic appearance of an eyeglass lens processing apparatus that is an embodiment of the present invention.

Hereinafter, embodiments according to the present invention will be described with reference to the accompanying drawings. FIG. 1 is a view showing a schematic appearance of an eyeglass lens processing apparatus 1 according to an embodiment of the present invention. An eyeglass frame measuring device 2 is provided in the processing apparatus 1. As the measuring device 2, for example, measuring devices as disclosed in U.S. Pat. No. 5,333,412 (JP-A No. 4-93164), US Re. 35898 (JP-A No. 5-212661), and the like can be used. A switch portion 410 which includes switches for operating the measuring device 2, a display portion 415 which displays processing information, etc., and a switch portion 420 which includes switches for inputting processing conditions and the like and for processing instructions are provided on the front of the measuring device 2. A lens to be processed is processed in a processing chamber inside an opening/closing window 402.

Figure 2:
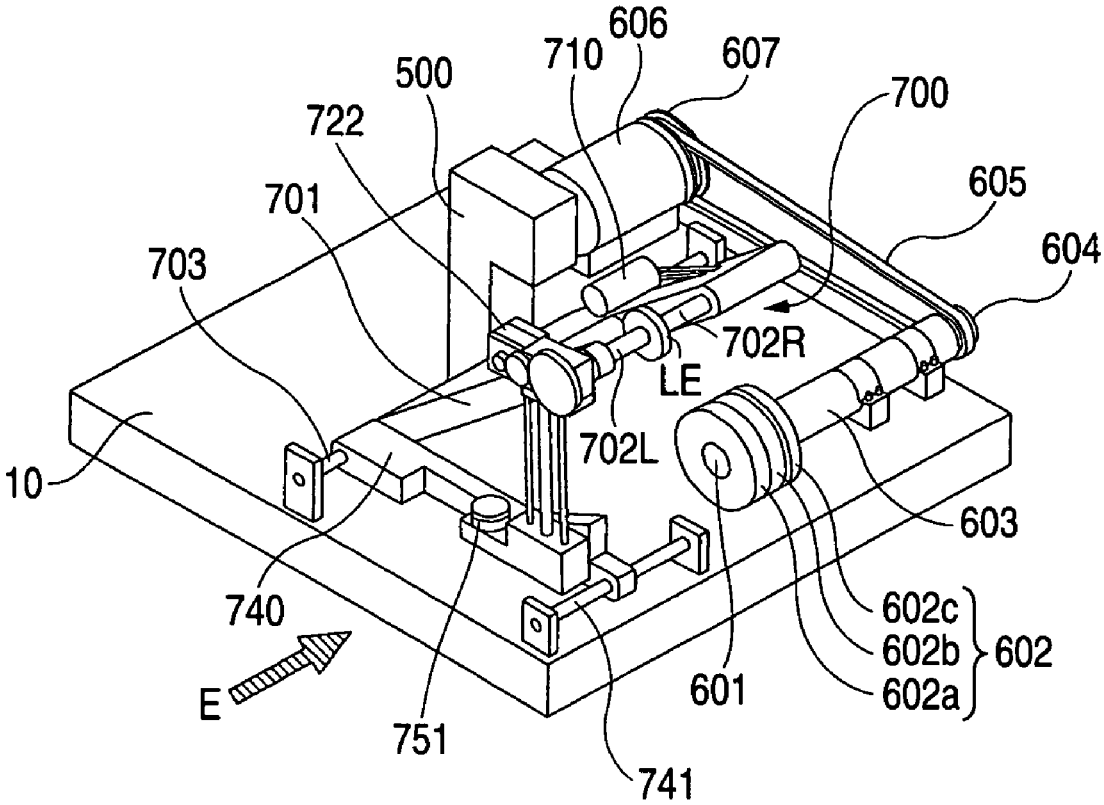
FIG. 2 is a view showing a schematic configuration of a lens processing section.
Figure 3A:
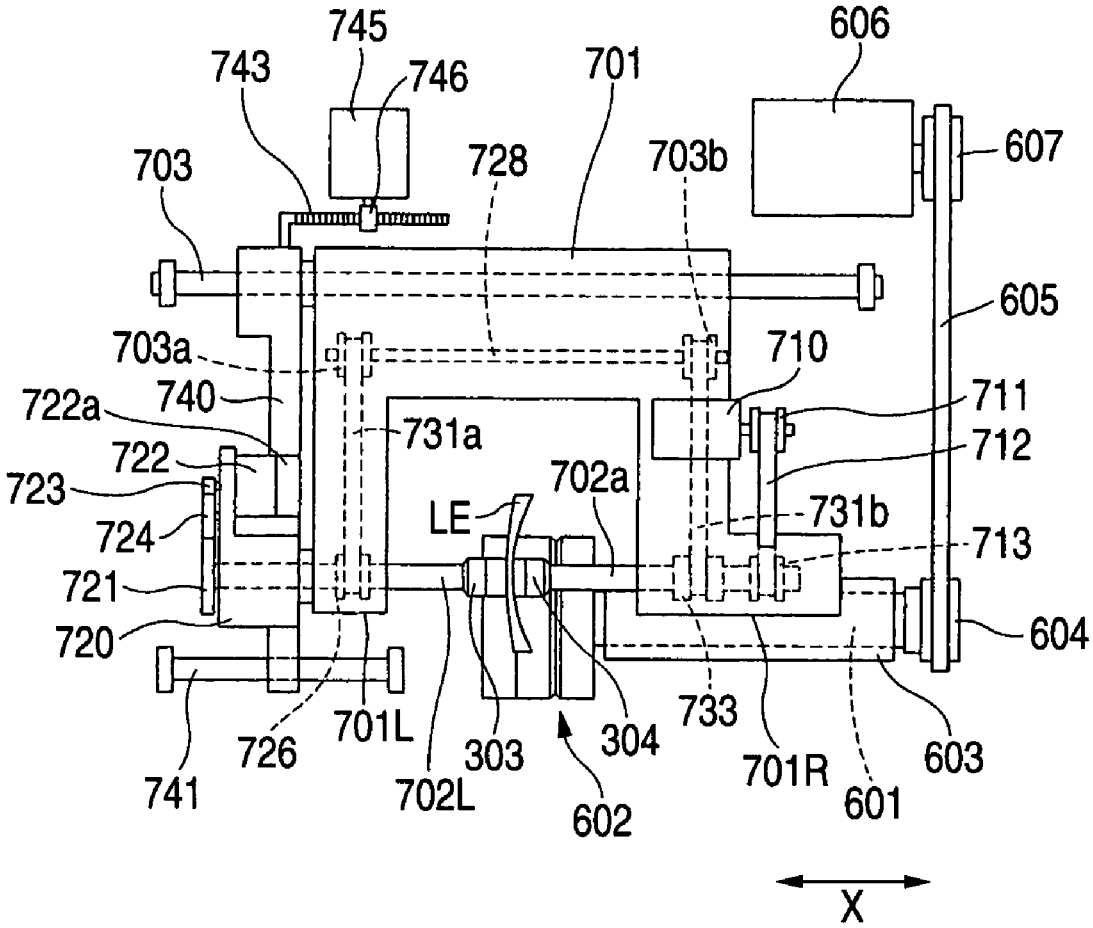
FIG. 3 illustrates a schematic configuration of a carriage portion of the lens processing section.
Figure 3B:
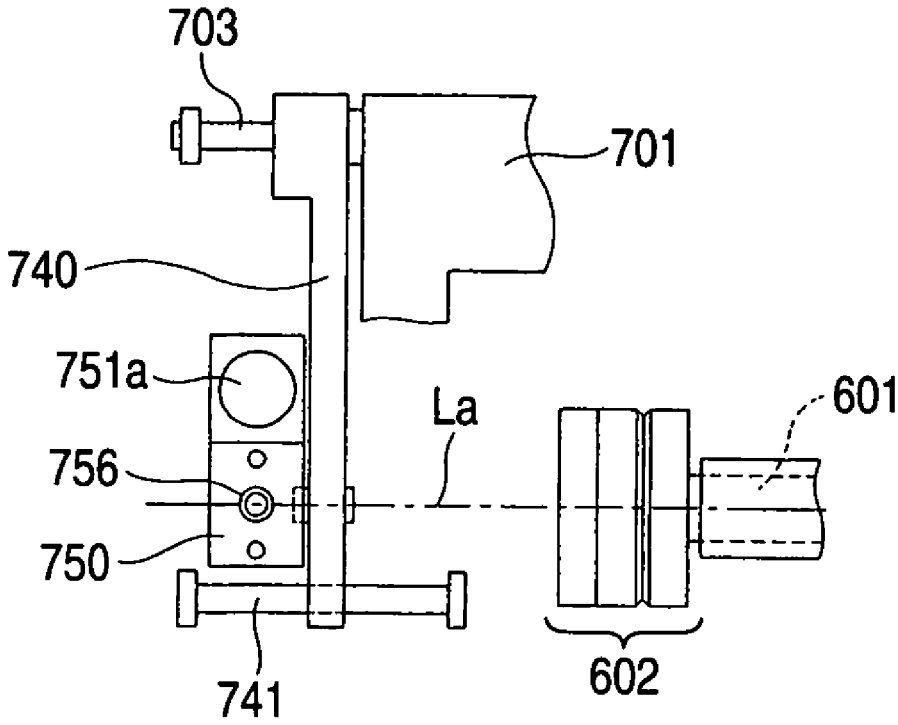
Figure 4:
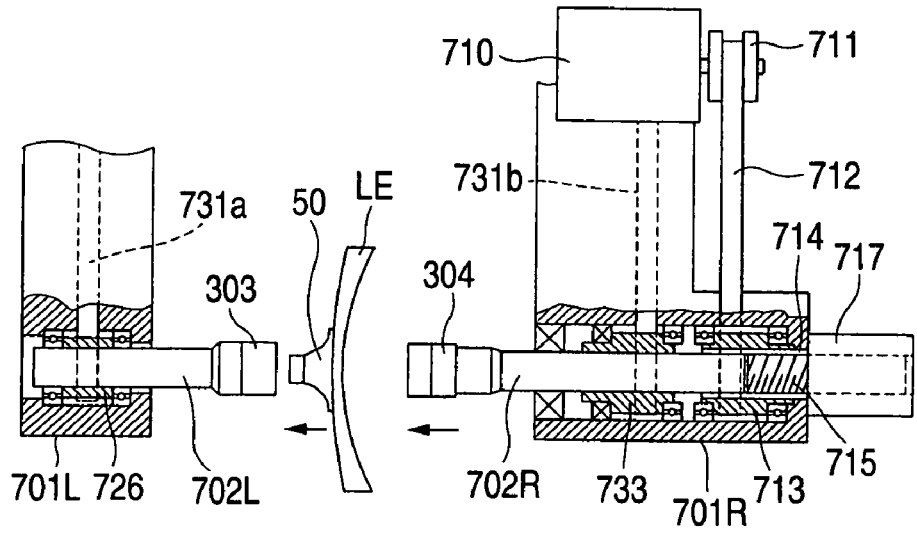
FIG. 4 is a view showing a schematic configuration of a lens holding (chucking) mechanism.
Figure 5:
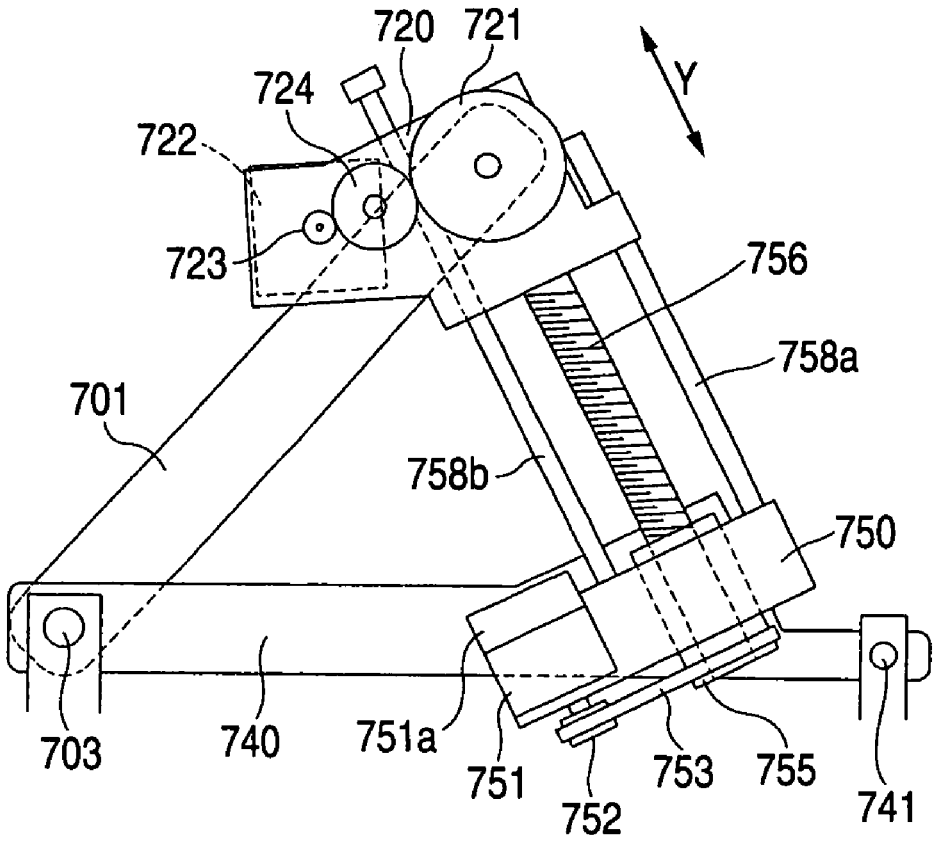
FIG. 5 is a view when the carriage portion in FIG. 2 is seen from a direction E.

FIG. 2 is a view showing a schematic configuration of a lens processing section disposed within a housing of the processing apparatus 1. FIGS. 3A and 3B illustrate a schematic configuration of a carriage portion 700 of the lens processing section. FIG. 4 is a view showing a schematic configuration of a lens holding (chucking) mechanism. FIG. 5 is a view when the carriage portion 700 in FIG. 2 is seen from a direction E.

The carriage portion 700 including a carriage 701 and its moving mechanism is mounted on a base 10. A lens LE to be processed is rotated while being held (chucked) by lens chucks 702L and 702R which are rotatably held by the carriage 701, and is ground by a grindstone 602. The grindstone 602 according to the present embodiment includes a roughing grindstone 602*a* for plastic, a roughing grindstone 602*b* for glass, and a bevel-finishing and plane-finishing grindstone 602*c*. A grindstone spindle 601 to which the grindstone 602 is attached is rotatably held by a bearing 603. The rotation of the grindstone rotating motor 606 fixed to the base 10 is transmitted to the grindstone spindle 601 via a pulley 607 attached to a rotating shaft of the motor 606, a belt 605, and a pulley 604 attached to an end of the grindstone spindle 601. Thereby, the grindstone 602 attached to the grindstone spindle 601 is rotated.

A lens shape measuring section 500 is provided (disposed) at the back side (inner side) of the carriage 701.

The lens chucks 702L and 702R are held by the carriage 701 such that the central axis of the lens chucks 702L and 702R (the central axis of rotation of the lens LE) may be parallel to the central axis of the grindstone spindle 601 (the central axis of rotation of the grindstone 602). The carriage 701 is movable in the direction of the central axis of the grindstone spindle 601 (the direction of the central axis of the lens chucks 702L and 702R) (X direction). The carriage 701 is also movable in the direction in which the axis-to-axis distance between the central axis of the lens chucks 702L and 702R and the central axis of the grindstone spindle 601 changes (Y direction).

<Lens Holding (Chucking) Mechanism>

The lens chucks 702L and 702R are rotatably and coaxially held by left and right arms 701L and 701R, respectively, of the carriage 701. A cup receiver 303 is fixed to a distal end of the lens chuck 702L, and a lens presser 304 is fixed to a distal end of the lens chuck 702R. A lens chucking motor 710 is fixed to the right arm 701R. The rotation of the motor 710 is transmitted to a female screw 714 via a pulley 711 attached to a rotating shaft of the motor 710, a belt 712, and a pulley 713 attached to the female screw 714 disposed in the right arm 701R. In the right arm 701R, a feed screw 715 meshes with and is inserted into the female screw 714, and the feed screw 715 can be moved in its axial direction and cannot be rotated due to a guide 717. Accordingly, when the female screw 714 is rotated, the feed screw 715 is moved in its axial direction. As a result, the lens chuck 702R connected to the feed screw 715 is moved in its axial direction. When the lens LE is processed, a cup 50 that is a fixture is attached to the front refractive surface of the lens LE, and a base of the cup 50 is mounted to the cup receiver 303 fixed to the lens chuck 702L. The lens chuck 702R is moved closer to the lens chuck 702L by the driving of the motor 710, the lens presser 304 fixed to the lens chuck 702R abuts on the rear refractive surface of the lens LE, and the lens LE is held (chucked) by the lens chucks 702L and 702R. The chucking pressure at this time is detected by the current flowing through the motor 710, and is changed by supplying current corresponding to a desired chucking pressure.

<Lens Rotating Mechanism>

A lens rotating motor 722 is fixed to a block 720 attached to the left arm 701L. The rotation of the motor 722 is transmitted to the lens chuck 702L via a gear 723 attached to a rotating shaft of the motor 722, a gear 724, and a gear 721 attached to the lens chuck 702L. Further, the rotation of the motor 722 is transmitted to the lens chuck 702R via a pulley 726 attached to the lens chuck 702L, a belt 731*a*, pulleys 703*a* and 703*b* attached to both ends of a rotating shaft 728, a belt 731*b*, and a pulley 733 attached to the lens chuck 702R. Thereby, the lens chucks 702L and 702R are rotated in synchronization with each other, and the held (chucked) lens LE is then rotated. Incidentally, a servo motor is used as the motor 722, and its rotating shaft is provided with an encoder 722*a* which detects a rotational angle. The motor 722 generates torque when a load is applied to its rotating shaft.

<X-Direction Moving Mechanism of Carriage 701>

A moving arm 740 coupled with the carriage 701 is supported on guide shafts 703 and 741 fixed parallel to each other on the base 10 such that it is movable in the X direction. Further, a motor 745 for movement in the X direction is fixed onto the base 10. The rotation of the motor 745 is transmitted to the arm 740 via a pinion gear 746 attached to a rotating shaft of the motor 745, and a rack gear 743 attached to a rear portion of the arm 740. Thereby, the carriage 701 along with the arm 740 is moved in the X direction.

<Y-Direction Moving Mechanism of Carriage 701>

As shown in FIG. 3B, a block 750 is attached to the arm 740 so as to be rotatable about an axis La which coincides with the central axis of the grindstone spindle 601. Further, the distance from the central axis of the shaft 703 to the axis La, and the distance from the central axis of the shaft 703 to the central axis of the lens chucks 702L and 702R are set to be equal to each other. A motor 751 for movement in the Y direction is fixed to the block 750. The rotation of the motor 751 is transmitted to a female screw 755, which is rotatably held by the block 750, via a pulley 752 attached to a rotating shaft of the motor 751 and a belt 753. A feed screw 756 meshes with the female screw 755 and is inserted therethrough. The feed screw 756 is moved up and down in its axis direction by the rotation of the female screw 755. An upper end of the feed screw 756 is fixed to the block 720. When the feed screw 756 is moved up and down by driving the motor 751, the block 720 is moved up and down along guide shafts 758*a* and 758*b*, and the carriage 701 to which the block 720 is attached is also changed in its up-and-down position (Y direction position). That is, the carriage 701 is turned about the shaft 703 as its rotation center, and then the axis-to-axis distance between the lens chucks 702L and 702R and the grindstone spindle 601 is changed. The processing pressure of the lens LE (the pressing pressure of the lens LE against the grindstone 602) is generated by the control of torque of the motor 751. The torque of the motor 751 is adjusted by a voltage applied to the motor 751 (a current flowing through the motor 751), and thereby the processing pressure is also adjusted. In addition, in order to reduce a downward load of the carriage 701, it is preferable that a compression spring or the like is provided between the left arm 701L and the arm 740. Further, as a mechanism for adjusting processing pressure, a spring which pulls the carriage 701 in a direction in which it approaches the grindstone 602, and a mechanism which changes the force of the spring may be used. Incidentally, a servo motor is used as the motor 751, and its rotating shaft is provided with an encoder 751*a*, which detects a rotational angle.

Figure 6:
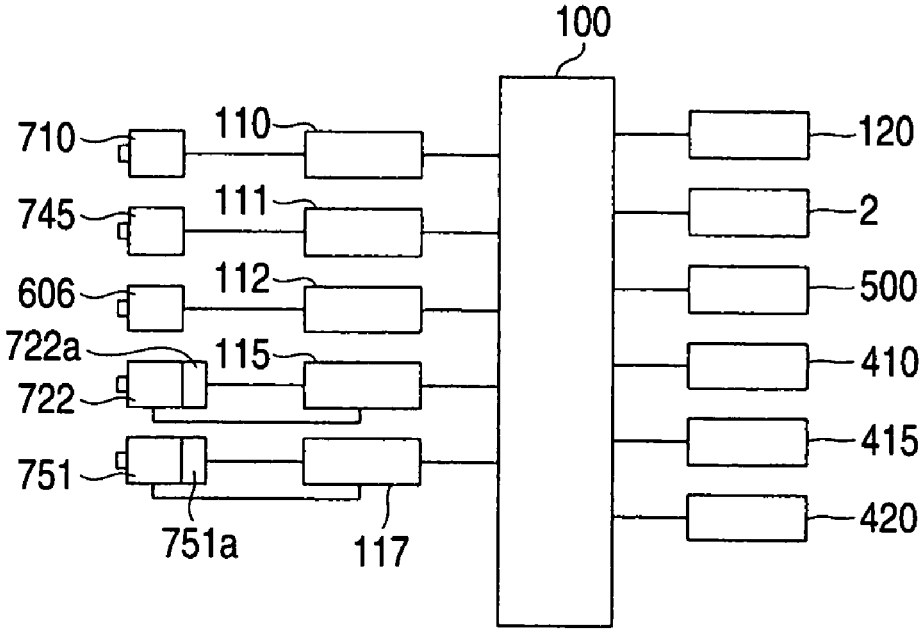
FIG. 6 is a schematic block diagram of a control system of the present apparatus.

Next, the operation of the present apparatus will be described with reference to a schematic block diagram of a control system of the present apparatus in FIG. 6.

First, a method of suppressing axis deviation when the lens LE having the surface slipping readily is processed will be described. When the lens LE having the surface slipping readily is processed, "ON" of a processing mode for suppressing axis deviation (hereinafter, refer to a soft processing mode) is selected by a switch 421*a* of the switch portion 420. An arithmetic control portion 100 controls the driving of the motor 745 via a driver 111 so as to move the carriage 701 in the X direction and locate the lens LE on the roughing grindstone 602*a*. Next, the arithmetic control portion 100 controls the driving of the motor 722 via a driver 115 to rotate the lens LE, and the driving of the motor 751 via a driver 117 to move the carriage 701 in the Y direction to perform roughing such that the lens LE is pressed against the rotating roughing grindstone 602*a*. The rotational angle of the lens LE (the lens chucks 702L and 702R) is detected by the encoder 722*a*. Further, the axis-to-axis distance between the lens chucks 702L and 702R and the grindstone spindle 601 which indicates a movement position of the carriage 701 in the Y direction is detected by the encoder 751*a*.

Figure 7:
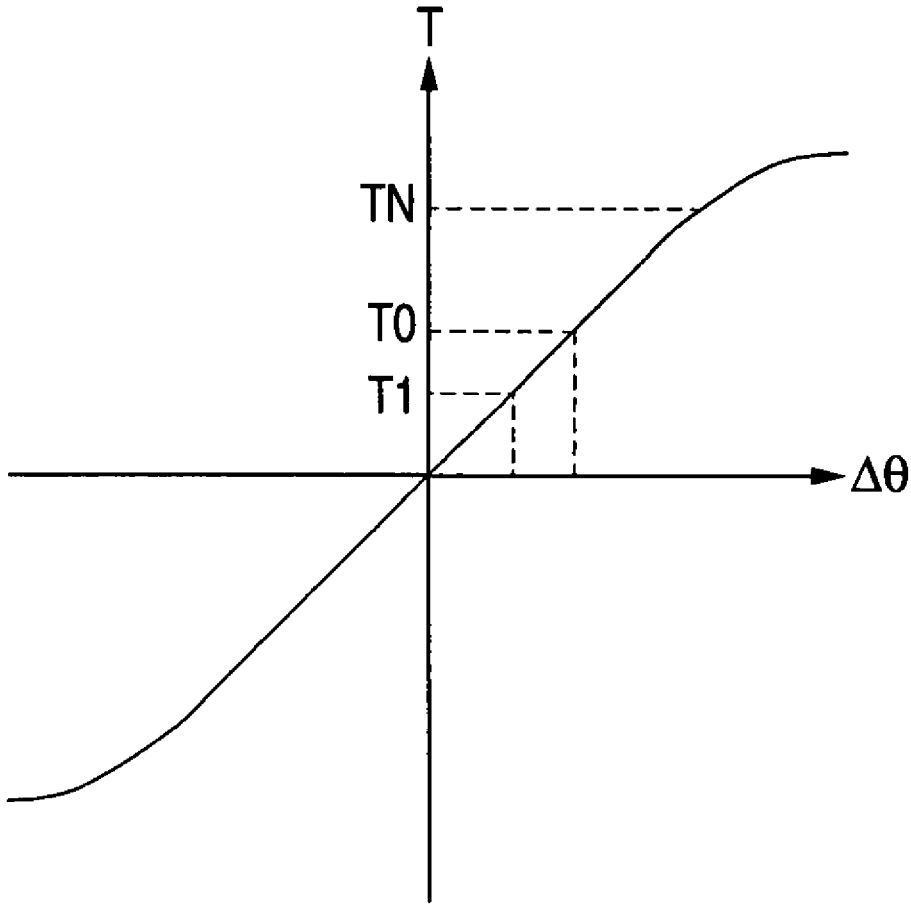
FIG. 7 is a view showing the relationship between rotational angle error and torque.

During processing of the lens LE, if an excessive load above the holding (chucking) force of the lens chucks 702L and 702R is applied to the lens LE, axis deviation may occur in the rotation direction between the cup 50 and the lens LE. A command pulse signal for rotating the lens LE at every rotational angle is sent to the motor 722. Simultaneously, the rotational angle of the rotating shaft of the motor 722 is detected by the encoder 722*a*. In the driver 115, the rotation command pulse signal to the motor 722 is compared with the rotation detection pulse signal from the encoder 722*a*. Here, if there is any deviation between both, a voltage applied to the motor 722 (a current flowing through the motor 722) is changed in order to cancel this deviation. By such feedback control, if a load caused by the processing is applied to the rotating shaft of the motor 722, the motor 722 increases torque to return the rotational angle to a commanded rotational angle. The torque T at this time, as shown in FIG. 7, is in a relation approximately proportional to the rotational angle error $\Delta\theta$ (an error between the rotation instruction pulse signal to the motor 722 and the rotation detection pulse signal from the encoder 722*a*). Accordingly, the torque T of the motor 722 is indirectly obtained from the rotational angle error $\Delta\theta$.

If the torque T exceeds an allowable torque level T0 of the lens LE, the arithmetic control portion 100 controls the driving of the motor 722 to reduce the torque and reduce the rotational speed of the lens LE (also including stopping the rotation of the lens LE). Otherwise, the arithmetic control portion controls the driving of the motor 751 for moving the carriage 701 in the Y direction to reduce the torque and reduce the processing pressure of the lens LE (also including pulling the lens LE away from the grindstone 602). The torque of the motor 751 can be detected from a current flowing through the motor 751 to be detected by a current detecting circuit possessed by the driver 117. Further, similar to the torque T of the motor 722, the torque of the motor 751 can also be detected on the basis of comparison between a rotation instruction pulse signal to the motor 751 and a rotation detection pulse signal from the encoder 751*a*. Incidentally, the allowable torque level T0 of the soft processing mode is a value that does not cause any axis deviation in the rotation direction between the cup 50 and the lens LE. Further, a value set in advance on the basis of surface-slipperiness, chucking pressure, and the like is stored in a memory 120.

If the torque T of the motor 722 falls below a torque level T1 (which is set on the basis of the allowable torque level T0 and stored in the memory 120) of the torque-up allowance which is set to be lower than the allowable torque level T0, the arithmetic control portion 100 controls the driving of the motor 722 or 751 via the driver 115 or 117 in order to increase the rotational speed or processing pressure of the lens LE. In this way, if the torque T of the motor 722 exceeds the allowable torque level T0, at least one of the rotational speed and the processing pressure of the lens LE is adjusted such that the torque T falls below the allowable torque level T0. As a result, a load acting on the lens LE is reduced and thus any axis deviation in the rotation direction of the lens LE is suppressed.

Meanwhile, when "OFF" of the soft processing mode is selected by the switch 421*a* (when a normal processing mode is selected), at least one of the rotational speed and the processing pressure of the lens LE is adjusted on the basis of an allowable torque level TN that is set to be sufficiently higher than the allowable torque level T0. Since a large load is applied to the lens LE so as to process the lens LE in the normal processing mode, it is possible to process the lens LE in a short time.

When the processing is performed, a target lens shape of a rim of an eyeglass frame or the like is measured by the measuring device 2 and the obtained target lens shape data is input by manipulation of the switch portion 420. The input target lens shape data is stored in the memory 120, and a target lens shape graphic based on the target lens shape data is displayed on the display portion 415. Accordingly, layout data on a wearer of the eyeglass frame, such as a pupillary distance (PD) and a distance between the centers of the right and left rims (FPD), is input by the manipulation of the switch portion 420. In addition, a mode for holding (chucking) the lens LE by using the lens chucks 702L and 702R (a mode of pressing the cap 50 against the lens LE) is selected from a frame center chucking mode and an optical center chucking mode, by using a switch 421*b* of the switch portion 420. In case of the optical center chucking mode, height data of the optical center of the target lens shape with respect to the geometric center of the target lens shape is input as layout data. Further, "ON" or "OFF" (in this case, a normal processing mode is selected) of the soft processing mode is selected by the switch 421*a* depending on whether the surface of the lens LE slips readily. Further, the input of the target lens shape, the input of the layout data, the selection of the chucking mode, the selection of the processing mode, and the like are performed by an apparatus separated from the processing apparatus 1, and the apparatus and the processing apparatus 1 are communicated with each other by radio or wires.

When the lens LE to which the cup 50 is attached is provided to the cup receiver 303, the lens LE is held (chucked) by the lens chucks 702L and 702R due to the manipulation of a chucking switch 422 of the switch portion 420. The chucking pressure at this time is a chucking pressure for provisional chucking, and is set to a small (low) chucking pressure to an extent that the lens LE is not separated (for example, 30 KgF).

Figure 8:
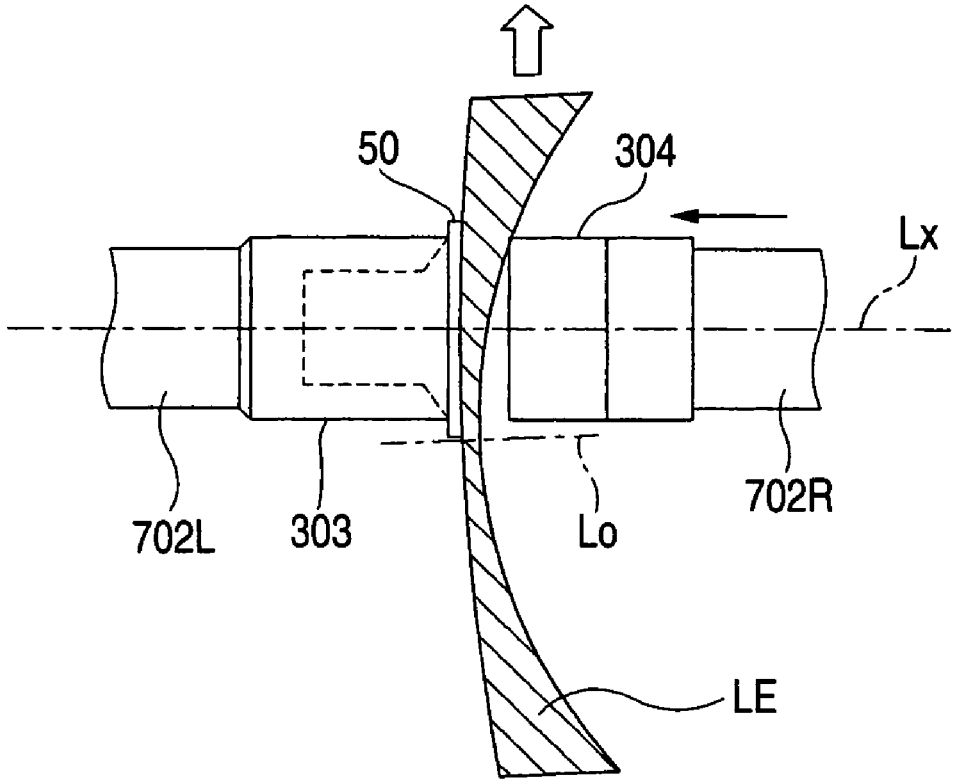
FIG. 8 is a view showing that a frame center of a lens is chucked by lens chucks.

When desired processing condition is input and the lens LE is provisionally chucked, the processing starts by the manipulation of a processing start switch 423 of the switch portion 420. The arithmetic control portion 100 controls the driving of the motor 710 via a driver 110 such that the chucking pressure becomes larger (higher) than the chucking pressure for provisional chucking. In this case, when the soft processing mode and the frame center chucking mode are selected, the arithmetic control portion 100 controls the driving of the motor 710 such that the chucking pressure becomes a chucking pressure K2 (for example, 40 KgF) smaller (lower) than a chucking pressure K1 (for example, 60 KgF) of the normal processing mode, not the soft processing mode. As shown in FIG. 8, the chucking pressure K2 of the soft processing mode is set to a value that does not cause any axis deviation in the lateral direction even when the lens LE is chucked, and is stored in the memory 120.

The arithmetic control portion 100 calculates vector information of the target lens shape data with the holding (chucking) center of the lens LE being the processing center on the basis of the target lens shape data and layout data. Further, the arithmetic control portion 100 calculates a processing point for every rotational angle of the lens LE on the basis of the obtained vector information and the radius R of the grindstone 602, and calculates the axis-to-axis distance L between the center axis of the lens chucks 702L and 702R and the center axis of the grindstone spindle 601 at the processing point.

Next, on the basis of the obtained data, the arithmetic control portion 100 makes the lens shape measuring section 500 perform measurement of the shapes (edge position) of the front refractive surface and the rear refractive surface of the lens LE. Then, the arithmetic control portion 100 calculates roughing data and finishing data by a predetermined program. Further, the arithmetic control portion 100 controls the driving of the motor 606 via a driver 112 so as to rotate the grindstone 602 at high speed, and sequentially performs roughing and finishing.

When the soft processing mode is selected to perform roughing, the arithmetic control portion 100 causes the torque T of the motor 722 not to exceed the allowable torque level T0. The allowable torque level T0 may also be set to a value that does not cause any axis deviation in the rotation direction of the lens LE at the chucking pressure K2. Thereby, the roughing is performed while axis deviation in the lateral direction and axis deviation in the rotation direction are prevented.

In addition, the finishing is controlled in the normal processing mode such that the lens LE is processed by a predetermined finishing amount (for example, 0.8 mm) per one rotation of the lens LE. On the other hand, the load applied to the lens LE is controlled in the soft processing mode to reduce the processing amount per one rotation of the lens LE. As a result, it is possible to perform finishing while suppressing the axis deviation.

Figure 9:
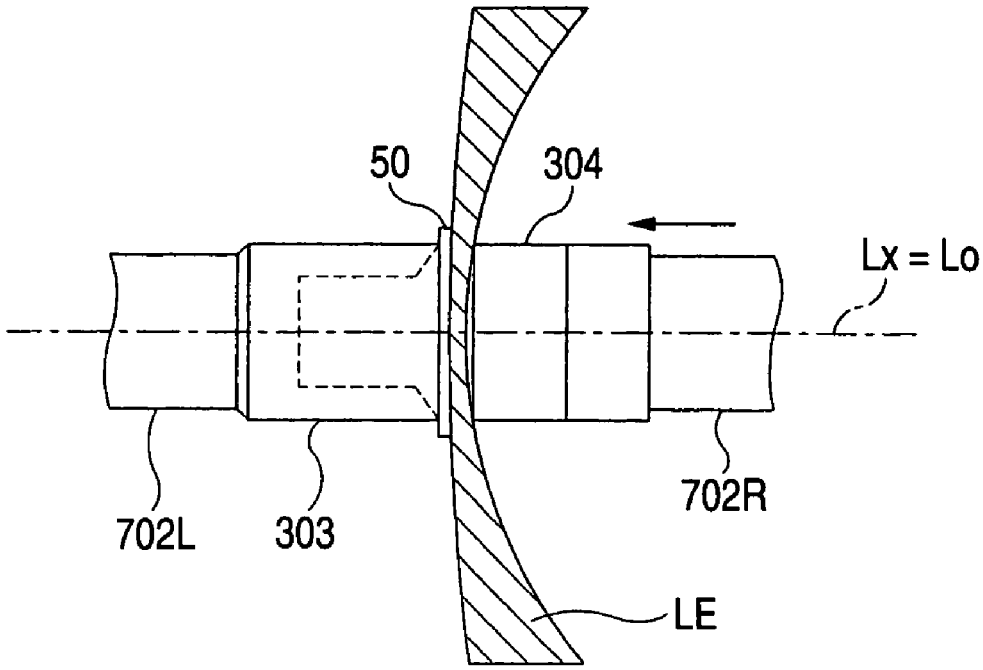
FIG. 9 is a view showing that an optical center of a lens is chucked by lens chucks.

A case where the soft processing mode is selected by the switch 421*a*, and a case where the optical center chucking mode is selected by the switch 421*b* will be described. In the optical center chucking mode, as shown in FIG. 9, the edge-thickness of the chucked portion of the lens LE is approximately uniform with respect to the central axis Lx of rotation of the lens chucks 702L and 702R. For this reason, even though the chucking pressure K3 of the soft processing mode and the optical center chucking mode is larger (higher) than the chucking pressure K2 of the soft processing mode and the frame center chucking mode, axis deviation in the lateral direction does not occur. As a result, the chucking pressure K3 may be equal to the chucking pressure K1 of the normal processing mode, and may be increased as long as the coating on the lens LE or the surface of the lens LE is not damaged.

Further, if the allowable torque level T0 of the soft processing mode is set to a value set on the basis of the small (low) chucking pressure K2 regardless of whether the optical center chucking mode or the frame center chucking mode is selected, the axis deviation is suppressed. However, it is preferable that the set value be changed so as to correspond to the selection of the chucking mode. That is, in the optical center chucking mode, if the allowable torque level T0 is set to a value set on the basis of the large (high)

chucking pressure K3, it is possible to reduce processing time. Meanwhile, in the frame center chucking mode, if the allowable torque level T0 is set to a value set on the basis of the small chucking pressure K2, processing time is increased to some extent but it is possible to suppress axis deviation.

In addition, in the normal processing mode, even though any one of the frame center chucking mode and the optical center chucking mode is selected, the chucking pressure becomes the large chucking pressure K1 and the allowable torque level TN higher than the allowable torque level T0. However, the present invention is not limited thereto. Like the soft processing mode, the chucking pressure of the optical center chucking mode is larger (higher) than that of the frame center chucking mode, and the allowable torque level TN may also be set to a value set on the basis of each of the chucking pressures.

What is claimed is:

1. An eyeglass lens processing apparatus comprising:

a lens chucking unit including two lens chucks for chucking an eyeglass lens and a first driver for moving at least one of the lens chucks in an axial direction of the lens chucks;

a lens rotating unit including a second driver for rotating the lens chucks;

an axis-to-axis distance changing unit including a third driver for changing an axis-to-axis distance between an axis of rotation center of a processing tool for processing a periphery of the lens and an axis of rotation center of the lens chucks;

a controller that controls at least one of the second driver and the third driver so that a processing load applied to the lens during processing falls below a predetermined allowable value; and a processing mode selector that selects one of a first processing mode in which the allowable value of the processing load is set to be high, and a second processing mode in which the allowable value of the processing load is set to be lower than the allowable value of the first processing mode so as to suppress axis deviation when the lens having a surface slipping readily is processed, wherein the controller controls the first driver so that a second chucking pressure of the lens chucks when the second processing mode is selected is smaller than a first chucking pressure of the lens chucks when the first processing mode is selected.

2. The apparatus according to claim 1, further comprising a chucking mode selector that selects a mode for chucking the lens by the lens chucks from an optical center chucking mode and a frame center chucking mode, wherein, when the second processing mode and the frame center chucking mode are selected, the controller controls the first driver so that the chucking pressure becomes the second chucking pressure.

3. The apparatus according to claim 2, wherein, when the second processing mode and the optical center chucking mode are selected, the controller controls the first driver so that the chucking pressure becomes a third chucking pressure larger than the second chucking pressure.

4. The apparatus according to claim 1, further comprising a chucking mode selector that selects a mode for chucking the lens by the lens chucks from an optical center chucking mode and a frame center chucking mode, wherein, when the frame center chucking mode is selected, the controller sets the allowance value of the processing load to be lower than the allowance value of the processing load when the optical center chucking mode is selected.

5. An eyeglass lens processing apparatus comprising:

two lens chucks that chuck an eyeglass lens;

a first motor that moves at least one of the lens chucks in an axial direction of the lens chucks;

a second motor that rotates the lens chucks;

a third motor that changes an axis-to-axis distance between an axis of rotation center of a processing tool for processing a periphery of the lens and an axis of rotation center of the lens chucks;

a controller that controls the driving of at least one of the second motor and the third motor so that a processing load applied to the lens during processing falls below a predetermined allowable value; and a processing mode selector that selects one of a first processing mode in which the allowable value of the processing load is set to be high, and a second processing mode in which the allowable value of the processing load is set to be lower than the allowable value of the first processing mode so as to suppress axis deviation when the lens having a surface slipping readily is processed, wherein the controller controls the first motor so that a second chucking pressure of the lens chucks when the second processing mode is selected is smaller than a first chucking pressure of the lens chucks when the first processing mode is selected.

6. The apparatus according to claim 5, further comprising a chucking mode selector that selects a mode for chucking the lens by the lens chucks from an optical center chucking mode and a frame center chucking mode, wherein, when the second processing mode and the frame center chucking mode are selected, the controller controls the first motor so that the chucking pressure becomes the second chucking pressure.

7. The apparatus according to claim 6, wherein, when the second processing mode and the optical center chucking mode are selected, the controller controls the first motor so that the chucking pressure becomes a third chucking pressure larger than the second chucking pressure.

8. The apparatus according to claim 5, further comprising a chucking mode selector that selects a mode for chucking the lens by the lens chucks from an optical center chucking mode and a frame center chucking mode, wherein, when the frame center chucking mode is selected, the controller sets the allowance value of the processing load to be lower than the allowance value of the processing load when the optical center chucking mode is selected.

* * * * *